US005671492A

United States Patent [19]

Simon

[11] Patent Number: 5,671,492

[45] Date of Patent: Sep. 30, 1997

[54] CONTOURED ASYMMETRICAL MATTRESS

[76] Inventor: Keith Douglas Simon, 1040 High Rd., Woodside, Calif. 94062

[21] Appl. No.: 403,406

[22] Filed: Mar. 14, 1995

[51] Int. Cl.[6] ..... A47C 27/14

[52] U.S. Cl. ..... 5/722; 5/731; 5/736; 5/738; 5/740; 5/901

[58] Field of Search ..... 5/448, 464, 465, 5/470, 481, 900.5, 901, 499, 500

[56] References Cited

U.S. PATENT DOCUMENTS

| | | | |
|---|---|---|---|
| 3,742,528 | 7/1973 | Munch | 5/465 |
| 3,846,857 | 11/1974 | Weinstock | 5/465 |
| 4,580,301 | 4/1986 | Ludman et al. | 5/481 X |
| 4,768,251 | 9/1988 | Baskent | 5/481 |
| 4,991,244 | 2/1991 | Walker | 5/470 X |
| 5,046,207 | 9/1991 | Chamberlain | 5/497 X |
| 5,179,742 | 1/1993 | Oberle | 5/481 X |

FOREIGN PATENT DOCUMENTS

| | | | |
|---|---|---|---|
| 1887195 | 3/1995 | United Kingdom | 5/464 |

*Primary Examiner*—Michael F. Trettel

[57] ABSTRACT

A mattress is provided with elevated chest support region and an arm well to reduce sleep disturbance in a person in the prone, sublime or side position. Said mattress is further provided with a firm zone at the foot of the mattress to assist persons transitioning onto and off of the mattress. An adjustable cover for said mattress is provided as is an improved method for packaging said mattress and cover.

40 Claims, 7 Drawing Sheets

CONTOURED ASYMMETRICAL MATTRESS

FIELD OF INVENTION

This invention relates to mattresses, specifically to a contoured mattress.

BACKGROUND OF THE INVENTION

Conventional mattresses have rectangular upper and lower surfaces and essentially uniform depth. Wedged, tapered and contoured mattresses are known in the prior art. See, U.S. Pat. No. 254,759 (Toberg); U.S. Pat. No. 4,829,615 (Raymond); U.S. Pat. No. 2,207,095 (Hutchinson); U.S. Pat. No. 2,462,579 (Warner); U.S. Pat. No. 4,972,535 (Goldman). A mattress assembly using a mattress with a plurality of foamed material layers also is known in the prior art. See, U.S. Pat. No. 3,837,566 (Bosch).

Prior art mattresses using multi-layer construction or wedge shaped design do not have the advantages associated with a laterally contoured mattresses, such as allowing the neck to freely extend when the mattress is used with a pillow. Prior art laterally contoured mattresses fail to elevate the chest region to reduce pressure on the vascular and respiratory systems and the effects of gravitational distortion on the body in the sublime, side, prone and sitting positions.

The contours and reenterant recesses of prior art mattresses have been designed to receive pillows, not to accommodate the arm of a person in the prone, sublime or side position. Such contours constrict circulation in the arm when it extends above the shoulder of a prone body lying on the mattress. The arc of contour of the present invention creates an arm well which, combined with the uniform incline of the mattress, allows the arm to bend upward from the elbow and be supported while perpendicular to the body, stretched parallel above the head, or any where within these ranges, without prohibitive pressure point support on the chest cavity below the shoulder joint.

Prior art mattresses also fail to support the buttocks and legs of a person sitting at the head end of the mattress, such as when reading a book or watching television. Further, prior art mattresses do not provide a firm zone at the foot of the mattress to make getting on and off of the mattress easier and to provide added support and durability at the foot of the mattress which is used as a seat, such as when people tie their shoes. The available shipping options of prior art mattresses, whether multilayered, wedged or contoured also is limited. The modular design of the mattress of the present invention allows air freight services to be economically utilized.

BRIEF DESCRIPTION OF THE INVENTION

The mattress shape and materials allows for conformity to and support of the body of a person in the prone, sublime or side potion and for a person sitting at the head or foot up the mattress. The head of the mattress is contoured to provide an arm well which encourages sleeping on the side without constricting circulation. The arm well further provides support for the buttocks and legs of a person sitting at the head of the mattress. The chest region of the mattress is elevated to reduce constriction on breathing and improve circulation. A firm zone in the foot region of the mattress provides support for a person sitting at the foot of the bed and additional support for getting onto or off of the mattress. The arm well, mattress materials, and the elevated chest region reduce pressure on the vascular system and reduce the effects of gravitational distortion to the body in either a prone or sitting position.

The mattress of the present invention may rest on a box spring, slats, platform or any firm surface such as the floor. When not in use, the mattress may be disassembled and stored. In one embodiment of the present invention, the components of the mattress are within the limitations on size and weight such that they can be economically shipped using standard air freight services. The modular design of the mattress provides the further advantage that as the mattress wears out and deforms, only certain components need be replaced, not the whole mattress. The materials of the mattress of the present invention are domestically washable, as is the mattress cover.

The principal modules of the mattress of the present invention consist of a top layer, a center core and a base. The top layer of the mattress is a low resilient layer of latex or a combination of latex and synthetic low resilient high density foams. In one embodiment of the present invention, the upper surface of the top layer includes lateral undulations to improve moisture and heat dissipation. Beneath the top layer is a contoured center core, which defines a portion of the mattresses arm well and the uniform gradient used to elevate the chest. The center core is a high resilience foam of medium density. The base is a high resilience, low density foam. The base may consist of one or more sections. In the preferred embodiment of the invention, the base consists of three sections. The base cradles the core and supports portions of the top layer. At the head end, the base is contoured to define the remaining portion of the arm well in conjunction with the center core.

The top to bottom transition from low to high density and high to low resilient foam creates a mattress that conforms to the body while providing adequate support. The transition of cell structure resilience and foam density from top to bottom can be adjusted to meet individual needs, based on weight, location of body density and bone structure.

Cell structure resilience, or firmness, is normally measured in terms of a "25% ILD range" which is the range of force or weight applied through a pre-crushed 20×20×4-inch specimen to 25% of its thickness. "ILD" is an abbreviation for "indent load depression."

The larger size mattresses of the present invention (e.g., Queen, California King and Eastern King) consist of two sets of top, core, and base layers side by side held in cooperation by a cover. These independent sides allow for individual firmness and softness, by making the center core softer or firmer and/or by the adjustment of the cover tensioning system.

In one embodiment of the mattress of the present invention, the cover (traditionally called—upholstery) is integral to the support, conformity and feel of the mattress. The cover holds the components of the mattress together and includes a cover tensioning system. The cover tensioning system utilizes a draw string to tighten the cover around the internal components thereby allowing for adjustment of the feel (e.g., softness and firmness) of the mattress. The cover tensioning system of this embodiment of the invention utilizes a plastic cam cleat to hold the draw string at any set tension allowing the user to self adjust the feel of his or her mattress.

OBJECTS OF THE INVENTION AND BRIEF DESCRIPTION OF THE FIGURES

It is an object of this invention to provide an improved contoured mattress.

It is another object of this invention to provide a contoured mattress that affords proper comfort and support to a person in the supine, prone or side position.

It is another object of this invention to provide a contoured mattress that reduces sleep disturbances associated with conventional mattresses.

It is another object of this invention to provide a contoured mattress that affords proper comfort and support to a persons sitting upright on the mattress.

It is another object of this invention to provide a contoured mattress with foot end that comfortably supports a sitting person and exhibits increased resilience to deformation from sitting over time.

It is another object of this invention to provide a contoured mattress that affords proper comfort and support to a person sitting at the head end of the mattresses by conforming to the buttocks and elevating the knees.

It is another object of this invention to provide a contoured mattress that is shippable by conventional means and by air freight.

Figures 5, 5A:
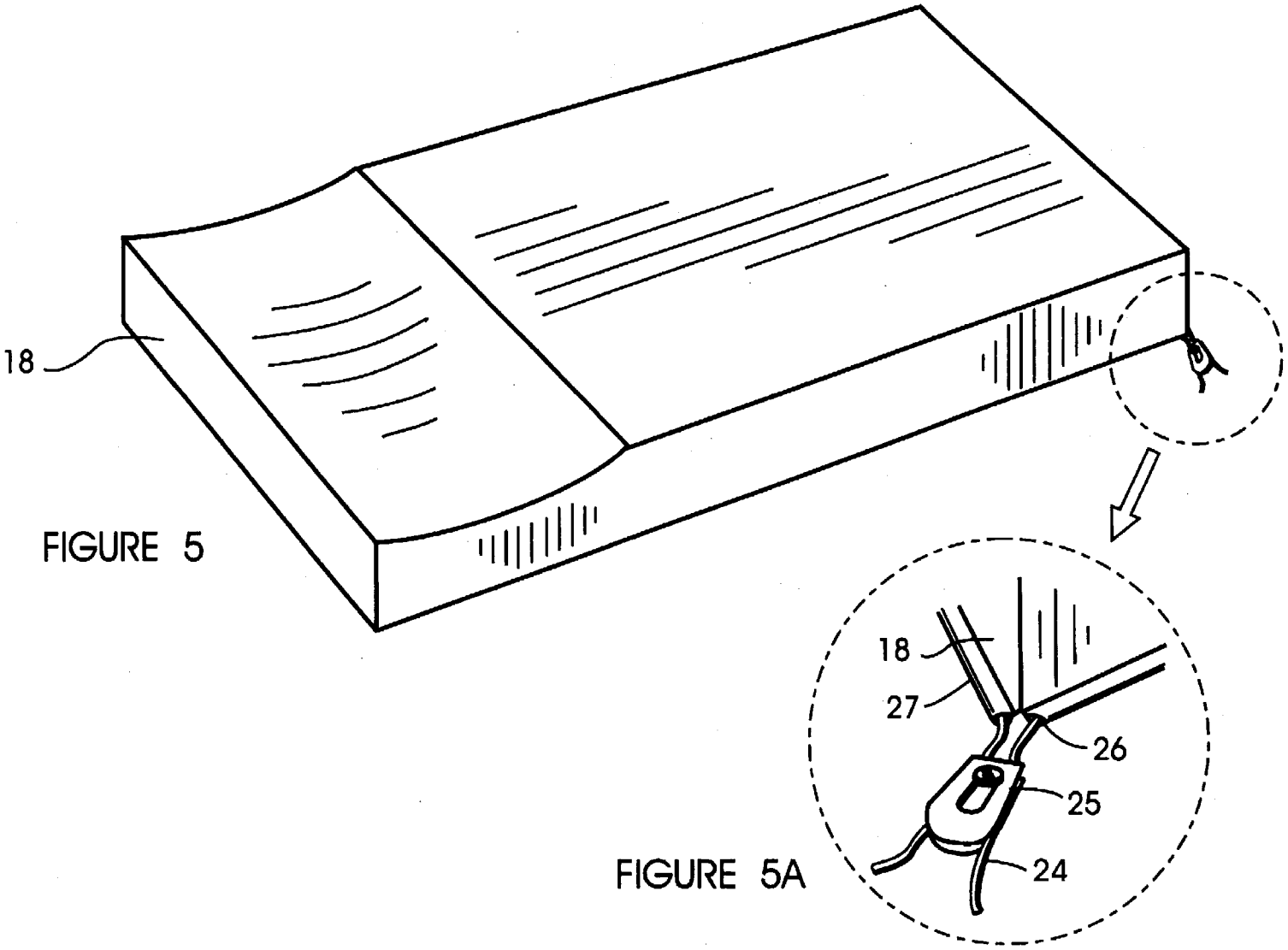
FIG. 5 is a perspective view of a cover of the mattress of the present invention.

FIG. 5*a* is a fragmentary view of the drawstring and fastener for the cover of the mattress of the present invention.

Figure 6:
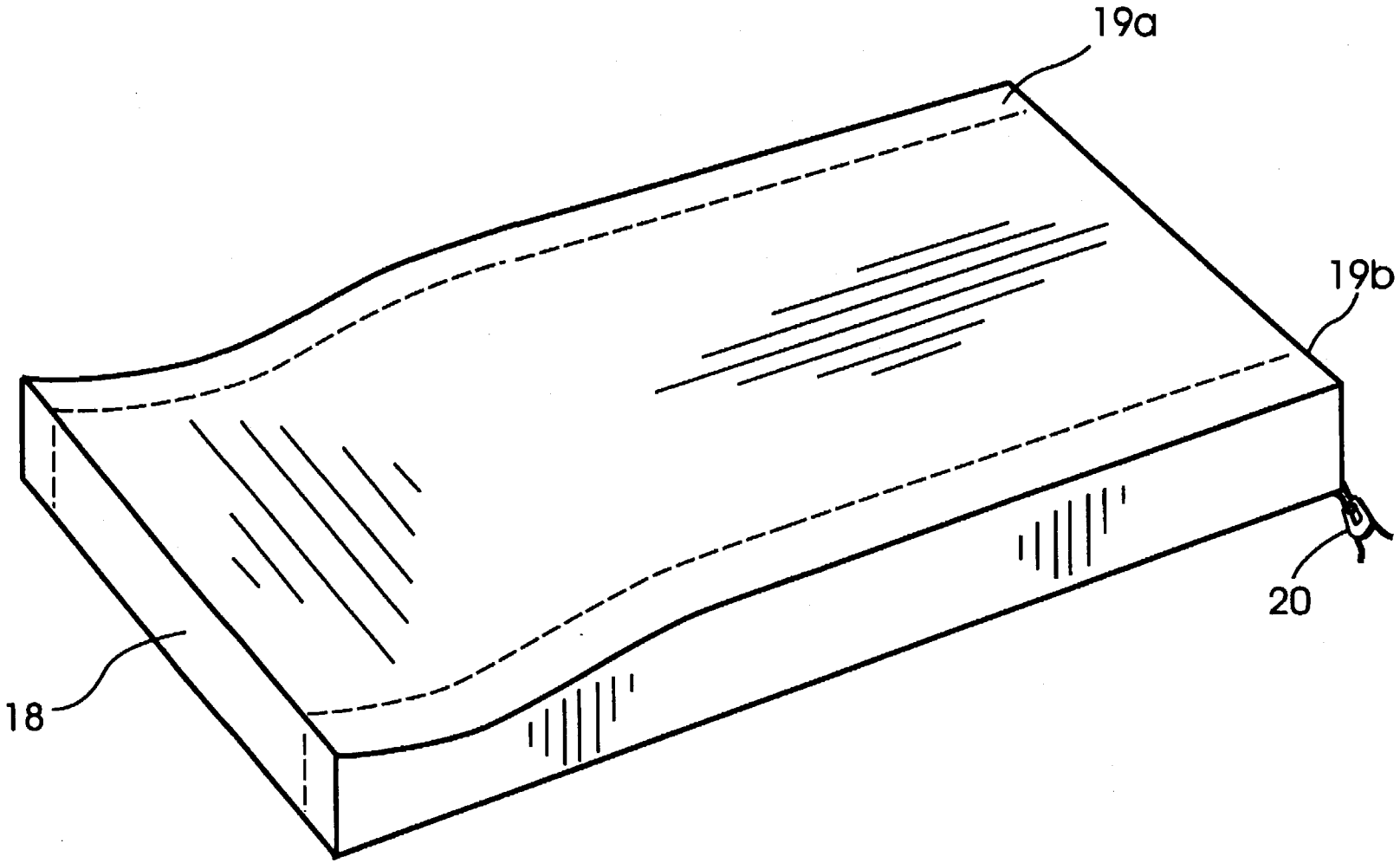

FIG. 6 is a perspective view of a cover of the mattress of the present invention.

Figure 7:
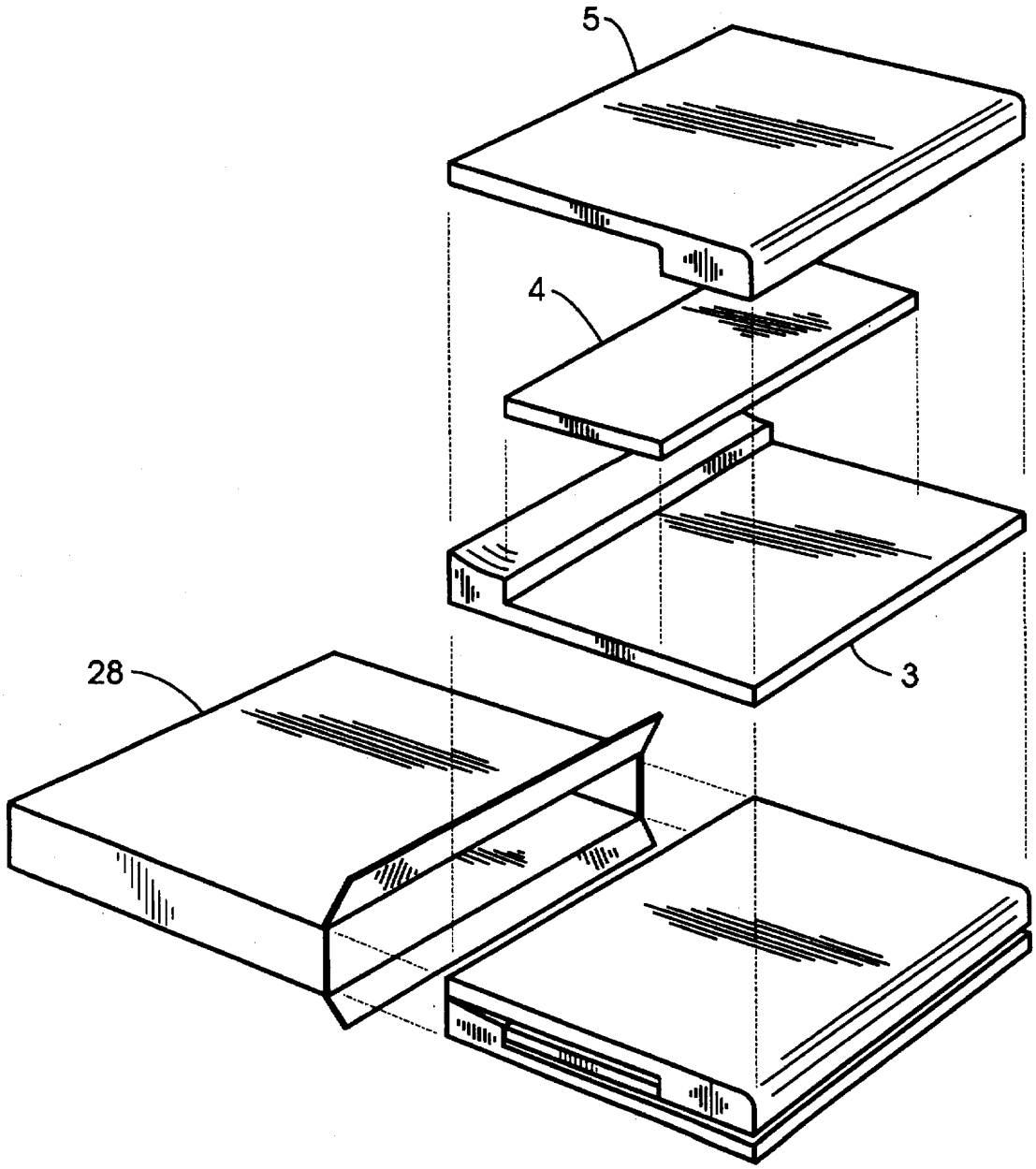

FIG. 7 is an exploded view showing the packaging of the base of the mattress of the present invention.

Figure 8:
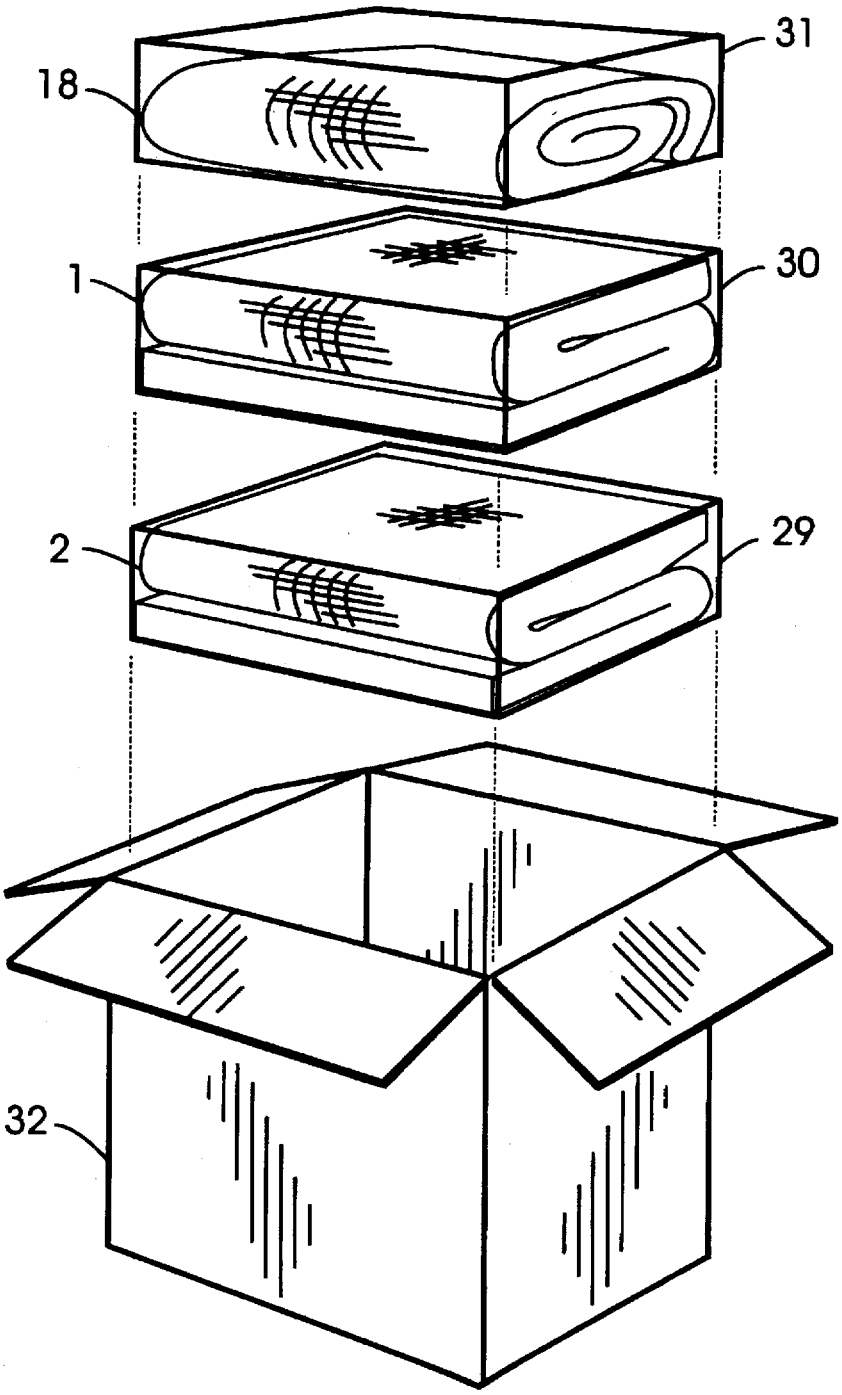

FIG. 8 is an exploded view showing the packaging of the cover, upper member and middle member of the mattress of the present invention.

DETAILED DESCRIPTION OF THE INVENTION

Figure 1:
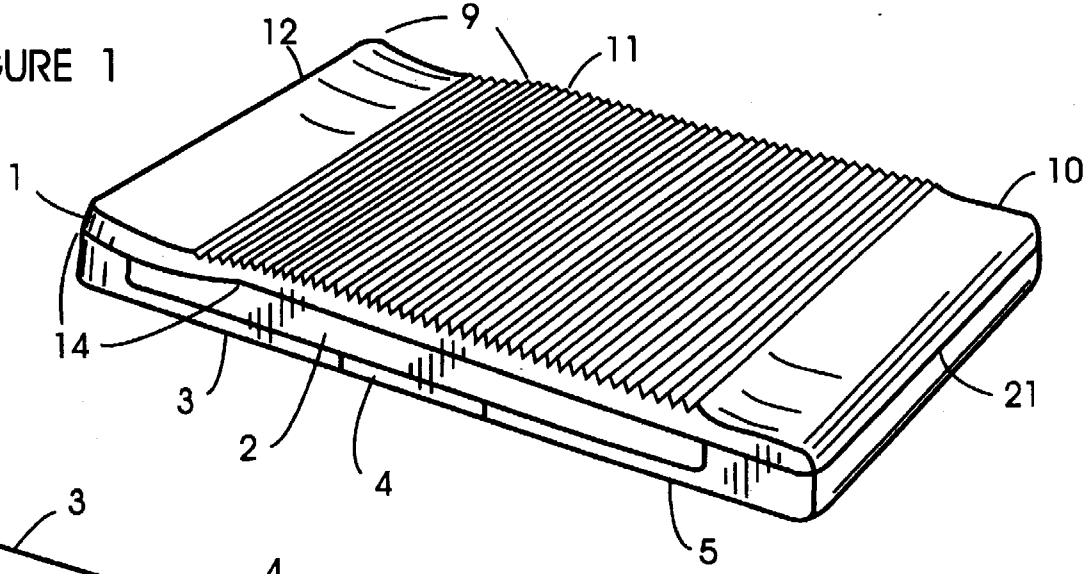
FIG. 1 is a perspective view of the mattress of the present invention.

FIG. 1 of the drawings shows a mattress 21 according to the present invention. The mattress shape and materials allow for conformity to and support of the body in sublime, prone or side and in sitting positions. The mattress 21 is formed from a plurality, five being shown, of modules 1, 2, 3, 4, 5 constructed of foamed material. Any suitable foamed material, such as polyurethane, of various densities may be used to construct the modules. Although five modules are shown, it is to be understood that the exact number of modules is not critical to the invention.

The top layer 1 of the mattress is constructed of a low resilient layer of latex or a combination of latex and synthetic low resilient high density foams. The best mode of the invention calls for use of material with a resilience in approximately the 16 to 22 pounds 25% ILD range and a density of 2 to 5 pounds per cubic foot. In the best mode of the present invention, the average thickness of the material comprising the top layer should be about 1 and ½ inches. Above the 1 and ½ inch lower limit, the thickness of the top layer is dependent on economic constraints and the availability of materials. However, the material should not be so thick that it fails to conform to the uniform concave arc formed by the upper surface of the center core 2 and the head section 3 of the base 22.

Upper surface of the top layer 1 is molded or otherwise prepared to provide a section 11 of uninterrupted continuous undulatory elevations and depressions 6 across the lateral dimension of the upper surface, and to provide a section 12 at the head end of the top layer and section 10 at the foot end of the top layer which are substantially flat. Although undulations are not required by the present invention and undulations of any size may be used, undulations approximately ¾ inches high allow for greater conformity to small human crenelations than in flat mattresses and assist air movement and insulation in the mattress 21. When a body rolls on the mattress, the air in the channels is forced out one side and drawn in on the other, the venturi effect drawing away body moisture. It should be understood, that although sections 12 and 10 are shown in FIG. 1 as being of substantially identical dimension along the longitudinal axis of the mattress, such is not critical to the nature of the invention, and sections 12 and 10 may be of different longitudinal dimensions.

The center core 2 of the mattress 21 is constructed of a high resilience foam of medium density. The best mode of the invention calls for use of material with a resilience in approximately the 18 to 23 pounds 25% ILD range and a density of 2 and ½ to 3 pounds per cubic foot. At its thickest point the center core 2 should be about 5 inches. Above this lower limit, the thickness of the center core is dependent on economic constraints and the availability of materials.

Figure 4:
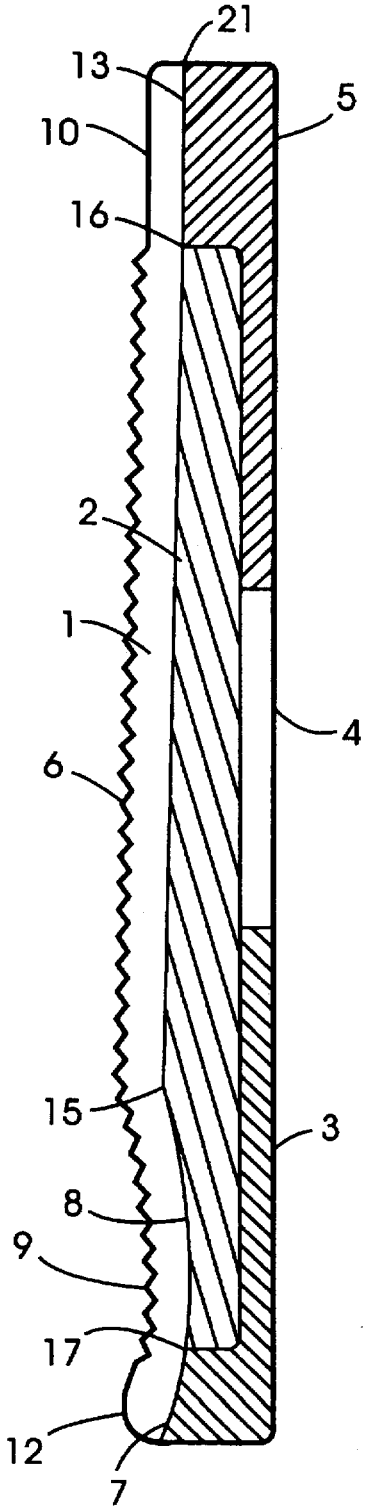
FIG. 4 is a side view of the mattress of the present invention.

As shown in FIG. 4, the center core 2 is contoured to form a concave arc 8 which defines a portion of the arm well 9 (FIG. 1) of the mattress 21. The concave arc 8 rises from the head edge 17 of the core 2 across its lateral axis to form a ridge 15 with the intersection of an inclined plane rising up with a uniform gradient from the longitudinally opposite, or foot, edge 16 of the core 2. The ridge 15 forms the thickest point of the core 2. In the best mode, this is about five inches thick and the differential in thickness between the ridge 15 and top of the foot edge 16 is about one inch. It is to be understood, however, that this thickness and differential are not critical to the present invention.

Figure 2:
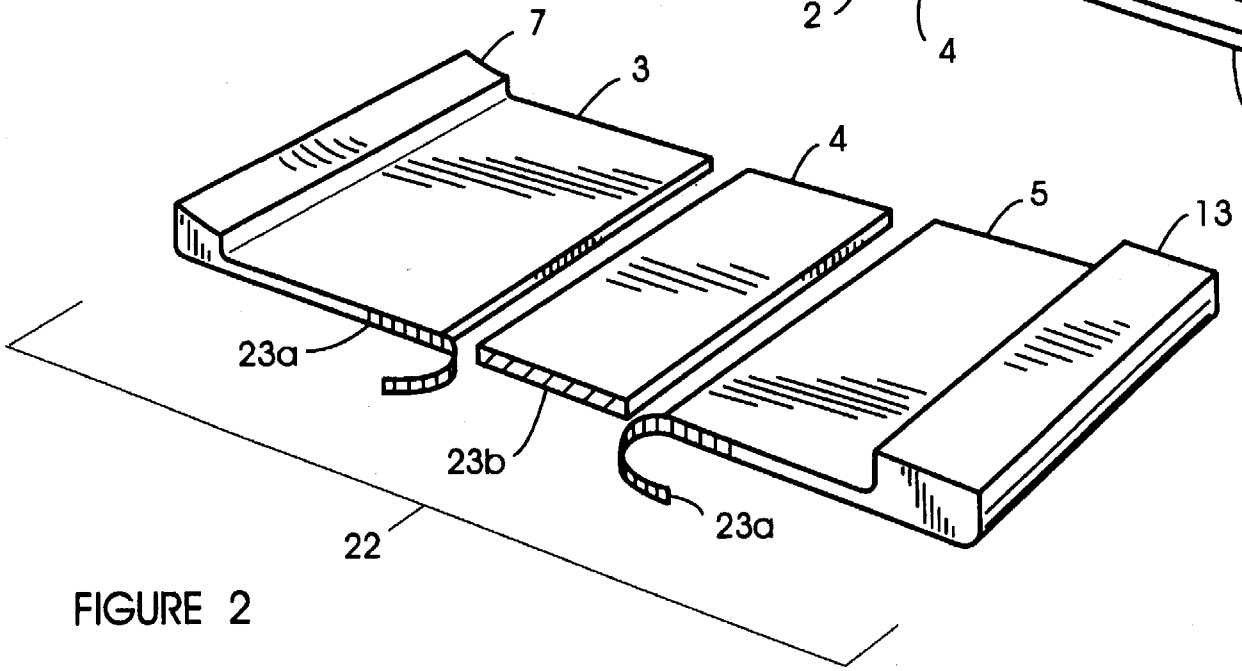
FIG. 2 is an exploded view of the base of the mattress of the present invention.

FIG. 2 shows one embodiment of the base 22. The components 3, 4, and 5 of base 22 are composed of high resilience, low density foam. The best mode of the invention calls for use of material with a resilience in approximately the 50 to 70 pounds 25% ILD range and a density of 1.8 to 2.2 pounds per cubic foot. At its thinnest point the base 22 should be about 2 inches. Above this lower limit, the thickness of the center core is dependent on economic constraints and the availability of materials.

The base 22 may consist of one or a plurality of sections such as shown in FIG. 2 in exploded form. In the preferred embodiment of the invention, the base 22 consists of three section 3, 4 and 5. In one embodiment, the head section 3 is connected to the core support section 4 by a fastener 23 such as mating VELCRO or generic hook and loop fastener strips 23*a* and 23*b*, as shown in FIG. 4, although other fastening techniques such as interlocking foam parts or such means as are generally known in the industry may be used. The foot section 5 is connected to the opposite edge of the core support section 4 also by appropriate fastening means, as also shown in FIG. 4. It is to be understood that while three sections 3, 4, and 5 are shown, the base 22 may be constructed of one or more sections.

Figure 3:
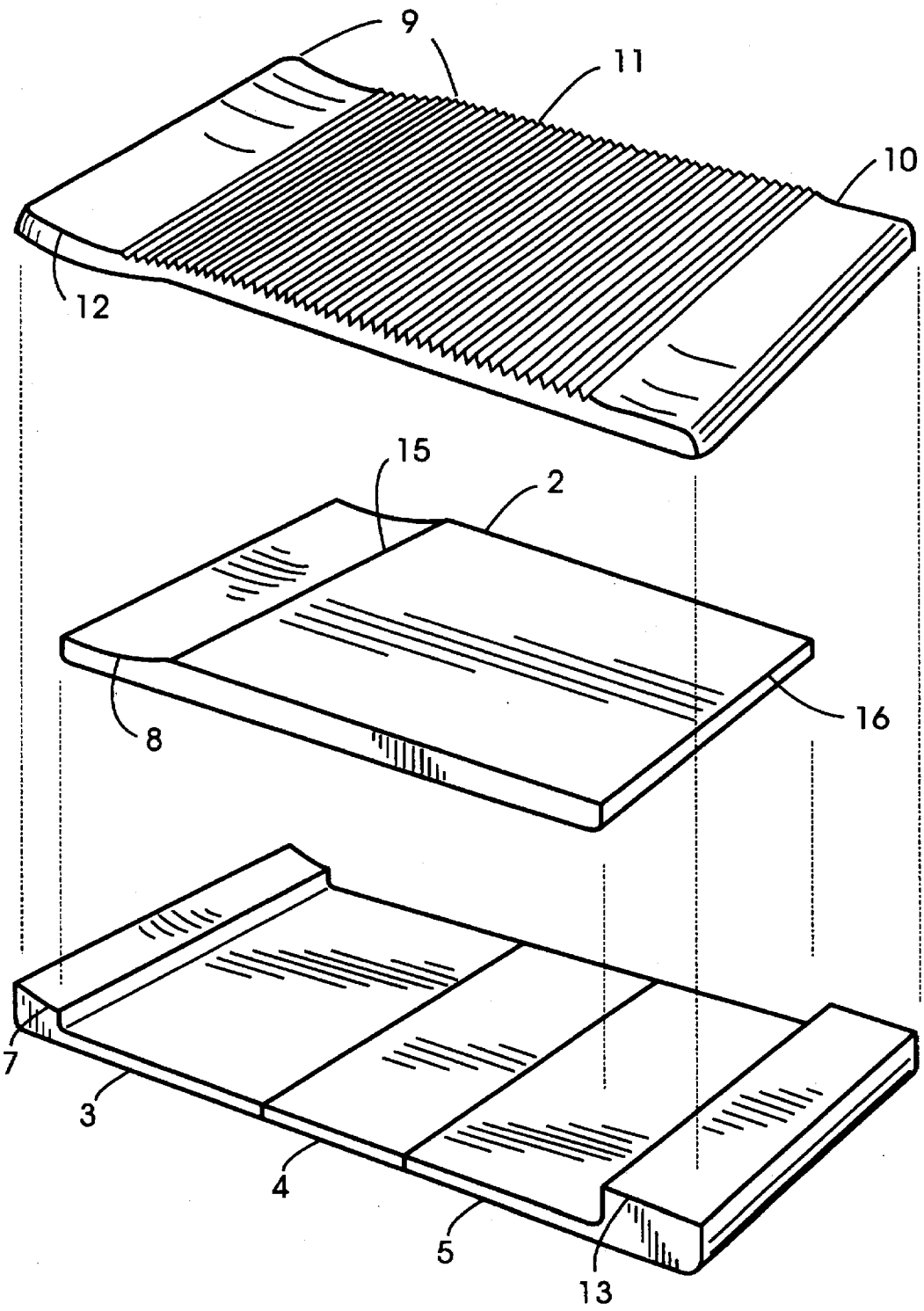
FIG. 3 is an exploded view of the mattress of the present invention

The mattress 21 is assembled as shown in FIG. 3. The head section 3 core support section 4 and foot section 5 of the base 22 are connected by fastening means 23*a* and *b* as shown in FIG. 4. The center core 2 is placed on the assembled base contoured side up, such that the concave arc of the head section 3 and the concave arc 8 of the center core 2 define a uniform concave arc 14 (FIG. 1) and that the opposite edge of the center core 2 abuts the vertical inner faced edge 5 of foot section. The top layer 1 which is flexible, is placed on the base 22 and center core 2 assembly, conforming to the contours of the upper surface of the base 22 and center core assembly. An arm well 9 (FIG. 1) is formed on the upper surface of the top layer 1 above the uniform concave arc formed by head section 3 of the base 22 and the center core 2. A firm zone is formed on the upper surface of the top layer above a portion 13 of the foot section 5 of the base 22 which abuts the center core 2 and directly supports the top layer 1.

The arm well 9 is defined by the curvature of the arc formed by 8 and 7 on the upper surface of the top layer and is adapted to accommodate the average human body length from the top of the head to the bottom of the shoulder joint. The arm well 9 allows the shoulder and arm to lie below the torso or chest cavity, thus allowing less restriction on the arms' vascular systems and less strain on the muscles, tendons, bones and shoulder joint. The arm well 9 allows for no less than about five degrees of inflection for the shoulder joint. This is accomplished by the drop in elevation on the upper surface of the top layer 1 above ridge 15 to the bottom of arm well and the uniform change in elevation above the foot edge 16 of center core 2 and the ridge 15. In the best mode of the present invention, this uniform change in elevation causes the ridge 15 to rise about one inch above the top of the foot edge 16.

The elevation increase along an approximately uniform gradient between ridge 15 and foot edge 16 allows for greater compliance for the upper torso as well. Said uniform gradient further provides increased gravitational resistance in the chest region of a person in the prone, sublime or side position to prevent hammocking of the mattress. The arm well 9 is positioned such that it also allows for proper posture for a person sitting at the head end of the mattress by conforming to the shape of the buttocks and an elevation of the knees thereby relieving pressure from the spine.

Along the foot end of the mattress, there is a translateral firm zone consisting of the high density, low ILD foam in the top layer 1 supported by and transitioning to the low density, high ILD foam of the foot section 5 of the base 22 within the upper 20% to 30% of the overall height of the mattress. Accordingly, the thickness of the top layer 1 is about 20 to 30% of the overall mattress height. This transition allows for vascular conformity for the feet of a person in the prone, sublime or side position and maintains sufficient support for use of the mattress edge as a seat. The firm zone's longitudinal dimension above portion 13 of foot section 5 is sufficient to provide proper seating for a person of average size. This firm zone eases the transition in standing up or sitting down from the foot of the mattress, which transition is a common source of injury, including muscle strain.

The cover 18 is shown in FIG. 5. The cover (18 is integral to the support, conformity and feel of at least one embodiment of the mattress of the present invention, including the best mode. The cover 18 assists in holding the components of the mattress—top 1 layer, center core 12 and the base 22 (as shown in FIGS. 1, 2, and 3)—together by wrapping around them much like a fitted sheet. The cover 18 fully encases the upper surface of the of the top layer 1 and the exposed outer edges of the top layer 1 center core 12 and base 22. The bottom surface of the base, is not more than partially encased by the cover 18.

A cover 18 is used to assist holding the various sections of the mattress 21 together and provides additional support for the mattress against deformation when subjected to a load. One embodiment of the cover of the mattress of the present invention, includes a cover tensioning system 20 (FIG. 6). As shown in FIG. 5*a* the cover tensioning system utilizing a draw string 24 extending through at least one opening 26 of a sleeve 27 contained along the outer edge of the cover 18 to tighten said cover 18 around the components of the mattress. The cover tensioning system 20 utilizes a cam cleat 25 to hold the draw string 24 at any set tension thereby allowing the user to adjust the mattress 21 for firmness and softness. Although a sleeve, drawstring and cam cleat are show, it is to be understood such is not necessary to the present invention and that any suitable method know in the industry as using straps attached to the cover can be used.

The cover tensioning system 20 can be used to adjust the feel, i.e., firmness, of the mattress. When tension in the draw string 24 is increased, the cover is drawn tighter around the mattresses foam components 1, 2, and 22. Like filling a balloon with air, the outer surface become firmer due to the increased pressure caused by the resilience of the foam components. The increased tension in the cover 18 also increases the rigidity of the base 22 and causes its outer edges to rise up toward the top of the mattress causing the cover 18 to stretch tight across the top surface.

As shown in FIG. 6, the cover 18 has two zones 19*a* and 19*b* that are approximately 3 inches wide, on the top of the cover 18 that run the length of the cover. The two zones 19*a* and 19*b* are less compliant than the rest of the cover 18. The zones 19*a* and 19*b* can be made by doubling up the density of fabric, by use of fill, or by use of a combination of fabric and fill or by adding a banding material of similar or dissimilar material to the cover 18. These less compliant zones increase the firmness of the top surface so that the user can recognize the edge of the mattress, and prevent themselves from unintended transitioning out of bed while sleeping. The cover is made of materials that can be domestically washed.

Unlike conventional mattresses with upholstery, the mattress 21 and cover 18 of the present invention are domestically washable. Further, if the mattress assembly wears out, only certain components need be replaced, not the whole mattress.

FIG. 7 shows an exploded view of the packaging a plurality of components of the base 22. Although three components 3, 4 and 5 are shown, it is to be understood that three components are not necessary to the present invention. The intermediate section 4 is placed on top of the head section 3 abutting the elevated contoured section 7. The foot section 5 is inverted and placed on top of the upper surface of the layered head section 3 and intermediate section 4. The head section 3 and the foot section 5 being arranged such that they form an essentially uniform outer surface of the layered components. The layered components are then placed within a box 28 with internal dimension approximately equal to the dimensions of the external surface of the layered base components.

FIG. 8 shows an exploded view of the packaging of the top layer of the mattress 1, the middle layer of the mattress 2 and the cover 18. The middle layer of the mattress is folded and vacuum packed within a bag 29. The best mode of the present invention is to make two folds to the middle layer 2. The top layer 1 is folded and vacuum packed within a bag 30. The best mode of the present invention is to make two folds to the top layer 1. The cover is folded and vacuum packed within a bag 31. Although the folds to the cover 18 are shown as a roll, it is to be understood that rolling the cover 18 is not essential to the present invention. The middle layer 2, the top layer 1 and the cover 18 are then placed within a box 32 with internal dimensions approximately equal to the outer surface dimensions of the middle layer 2, the top layer 1 and the cover 18 stacked on top of each other.

The preferred embodiment of the queen and king type sized mattresses, not shown, have two sets of top layers, central core, and bases, side by side, making up one mattress. These independent sides allow for individual firmness and softness, by making the center core softer or firmer and/or by the adjustment of the Cover Tensioning System. Further, this design recognizes the fact that person's body change temperature, expel moisture, and transition at different rates. Increased comfort and reduced sleep disturbance is achieved through the use of two independent sides which isolate the anatomical and physiological differences of two bodies sharing the same bed.

What is claimed is:

1. A mattress having a plurality of layers comprising:

a. an elongated base of generally uniform thickness;

b. at least one first raised section at one end of said base;

c. an elongated middle member adapted to be placed on top of at least a portion of said base adjacent to said raised section; and d. an elongated upper member adapted to be placed on to of at least a portion of said middle layer and said first raised section.

2. A mattress as described in claim 1 wherein said first raised section and said middle member each have contoured surfaces adapted to conform to one another to form a single continuous concave surface.

3. A mattress as described in claim 2 wherein said upper member is adapted to conform to said continuous concave-surface.

4. A mattress as described in claim 3 wherein said base includes a second raised section at the end of said base opposite said first raised portion which is in juxtaposition with one end of said middle member.

5. A mattress as described in claim 4 wherein said base comprises a plurality of base sections at least one of which has said first section at one end thereof and at least one other base section has said second raised section at one end thereof.

6. A mattress as in claim 5 wherein said second section supports at least a portion of said upper elongated member.

7. A mattress as described in claim 6 wherein said first and second section are integral with said base.

8. A mattress as described in claim 4 wherein said upper member includes a plurality of sections raised above the surface thereof forming uninterrupted continuous undulatory elevations and depressions across the lateral dimension of at least a portion of said upper member.

9. A mattress as described in claim 7 wherein said upper member includes a plurality of sections raised above the surface thereof forming uninterrupted continuous undulatory elevations and depressions across the lateral dimension of at least a portion of said upper member.

10. A mattress as described in claim 9 wherein said undulatory elevations and depressions are approximately three quarters of an inch high.

11. A mattress as described in claim 4 wherein said first and second sections are integral with said base.

12. A mattress as described in claim 7 wherein said first and second sections and said base are composed of a high resilience, low density foamed material; said middle member is composed of a high resilience, middle density foamed material; and said upper member is at least partially composed of latex.

13. A mattress as described in claim 9 wherein said first and second sections and said base are composed of a high resilience, low density foamed material; said middle member is composed of a high resilience, middle density foamed material; and said upper member is at least partially composed of latex.

14. A mattress as described in claim 4 further comprising a cover of fabric covering the top and sides formed by the layered elongated members and cover tensioning means contained in said cover.

15. A mattress as described in claim 9 further comprising a cover of fabric covering the top and sides formed by the layers of elongated members and cover tensioning means contained in said cover.

16. A mattress as described in claim 13 further comprising a cover of fabric covering the top and sides formed by the layers of elongated members and cover tensioning means contained in said cover.

17. A mattress as in claim 14 wherein said cover tensioning means consists of a sleeve along the outer edge of said cover with at least one opening in said sleeve and a drawstring contained within said sleeve and extending through said at least one opening.

18. A mattress as described in claim 17 further comprising a means for fastening said drawstring in communication with said drawstring.

19. A mattress as described in claim 4 wherein the maximum depth of the continuous concave surface of the first raised section and the middle member is in a range from about 7 to 16 inches horizontally from the edge of the mattress and the range of the radius of the arc of said continuous concave surface is from about 25 to 62 inches.

20. A mattress as described in claim 7 wherein the highest point on the contoured surface of said middle member adapted to conform to the contoured surface of the base to form a single continuous concave surface is higher than the longitudinally opposite edges of said single continuous contoured surface.

21. A mattress as described in claim 9 wherein the highest point on the contoured surface of said middle member adapted to conform to the contoured surface of the base to form a single continuous concave surface is higher than the longitudinally opposite edges of said single continuous contoured surface.

22. A mattress as described in claim 13 wherein the the maximum depth of the continuous concave surface of the first raised section and the middle member is in a range from about 7 to 16 inches horizontally from the edge of the mattress and the range of the radius of the arc of said continuous concave surface is from about 25 to 62 inches.

23. A mattress as described in claim 15 wherein the the maximum depth of the continuous concave surface of the first raised section and the middle member is in a range from about 7 to 16 inches horizontally from the edge of the mattress and the range of the radius of the arc of said continuous concave surface is from about 25 to 62 inches.

24. A mattress as described in claim 13 wherein the highest point on the contoured surface of said middle member adapted to conform to the contoured surface of the base to form a single continuous concave surface is higher than the longitudinally opposite edges of said single continuous concave surface.

25. A mattress as described in claim 16 wherein the highest point on the contoured surface of said middle member adapted to conform to the contoured surface of the base to form a single continuous concave surface is higher than the longitudinally opposite edges of said single continuous concave surface.

26. A mattress as described in claim 4 wherein the maximum depth of the continuous concave surface of the first raised section and the middle member is about 9 and ½ inches horizontally from the edge of the mattress and the radius of the arc of said continuous concave surface is about 29 inches.

27. A mattress as described in claim 7 wherein the maximum depth of the continuous concave surface of the first raised section and the middle member is about 9 and ½ inches horizontally from the edge of the mattress and the radius of the arc of the continuous concave surface is about 29 inches.

28. A mattress as described in claim 9 wherein the maximum depth of the continuous concave surface of the first raised section and the middle member is about 9 and ½ inches horizontally from the edge of the mattress and the radius of the arc of the continuous concave surface is about 29 inches.

29. A mattress as in claim 15 wherein the maximum depth of the continuous concave surface of the first raised section and the middle member is about 9 and ½ inches horizontally from the edge of the mattress and the radius of the arc of the continuous concave surface of said first raised section and said middle member is about 29 inches.

30. A mattress as contained in claim 24 wherein the maximum depth of the continuous concave surface of the first raised section and the middle member is about 9 and ½ inches horizontally from the edge of the mattress and the radius of the arc of the continuous concave surface of said first raised section and said middle member is about 29 inches.

31. A mattress having a plurality of layers comprising:

a. an elongated base of generally uniform thickness comprising a first section having a raised contoured surface on one end thereof, a second section having a raised contoured surface on one end thereof, each section adapted for placement adjacent to another section to form the base;

b. an elongated middle member adapted to be placed on top of at least a portion of said base between said raised sections having a contoured surface on one end thereof which communicates with the contoured surface of said first section to form a single continuous concave surface; and c. an elongated upper member adapted to be placed on top of at least a portion of said middle member and said first contoured surface adapted to conform to said continuous concave surface further comprising a plurality of uninterrupted continuous undulatory elevations and depressions across the lateral dimension of a least a portion of said upper member.

32. A mattress as in claim 31 wherein said elongated base is a high resilience, low density foamed material; said elongated middle member is a high resilience, medium density foamed material, and said elongated upper member is at least partially composed of latex.

33. A mattress as in claim 31 wherein said elongated base is a high resilience, low density foamed material; said elongated middle member is a high resilience, medium density foamed material, and said elongated upper member is composed of low resilience, high density foamed material.

34. A mattress as in claim 31 further comprising a cover of fabric covering the top and sides formed by the layers of elongated members and cover tensioning means contained in said cover.

35. A mattress as in claim 34 wherein the cover tensioning means consists of a sleeve contained along the outer edge of said cover and a drawstring contained within said sleeve.

36. A mattress as in claim 35 wherein said sleeve has at least one opening and said drawstring extends through said at least one opening.

37. A mattress as described in claim 35 further comprising a means for fastening said drawstring in communication with said drawstring.

38. A mattress as described in claim 32 further comprising a fabric cover covering the top and sides formed by the layers of elongated members and cover tensioning means contained in said cover.

39. A mattress as described in claim 31 wherein the highest point of the contoured surface of said middle member is higher than the longitudinally opposite edges of said contoured surface.

40. A mattress as in claim 39 wherein the lowest point of the continuous contoured surface of the first raised section of the base and the middle member is about 9 and ½ inches horizontally from the edge of the mattress and the radius of the arc of the continuous concave surface of said first raised section and said middle member is about 29 inches.

* * * * *